US005147991A

United States Patent [19]

Jordan, Sr.

[11] Patent Number: 5,147,991

[45] Date of Patent: Sep. 15, 1992

[54] ELECTRICAL SWITCH LOCKING SYSTEM

[76] Inventor: Nathaniel Jordan, Sr., 1266 Springwood Cir., Winston-Salem, N.C. 27107

[21] Appl. No.: 733,466

[22] Filed: Jul. 22, 1991

[51] Int. Cl.[5] ..... H01H 27/10

[52] U.S. Cl. ..... 200/43.14; 200/43.21

[58] Field of Search ..... 200/43.11, 43.14, 43.15, 200/43.16, 43.19, 43.21, 43.22, 327

[56] References Cited

U.S. PATENT DOCUMENTS

| | | | |
|---|---|---|---|
| 2,663,768 | 12/1953 | Sorensen | 200/43.15 |
| 2,849,552 | 8/1958 | Firestone | 200/43.15 |
| 3,214,530 | 10/1965 | Tharp et al. | 200/43.15 |
| 3,470,336 | 9/1969 | DeAngelo | 200/43.15 |
| 4,347,412 | 8/1982 | Mihara et al. | 200/43.15 |
| 4,467,152 | 8/1984 | Gordy | 200/43.15 X |
| 4,581,502 | 4/1986 | Grudzinskas | 200/43.16 |
| 4,733,029 | 3/1988 | Kobayashi | 200/43.15 |
| 4,882,456 | 11/1989 | Hovanic et al. | 200/43.15 |
| 4,897,515 | 1/1990 | Zubar et al. | 200/43.11 X |
| 4,978,816 | 12/1990 | Castonguay | 200/43.14 |
| 5,079,390 | 1/1992 | Costanzo et al. | 200/43.14 |

FOREIGN PATENT DOCUMENTS

| | | | |
|---|---|---|---|
| 554049 | 3/1958 | Canada | 200/43.21 |
| 1155963 | 12/1957 | France | 200/43.21 |
| 1451954 | 10/1976 | United Kingdom | 200/43.22 |

*Primary Examiner*—Henry J. Recla
*Assistant Examiner*—Glenn T. Barrett

[57] ABSTRACT

An assembly for selectively locking the operating handle of an electrical switch in either the ON or OFF position which includes a blocking member having a first portion for engaging a housing through which the switch handle projects, and a second portion defining a recess or opening for receiving therein the switch handle. A fastener extends through the blocking member and into the second portion recess for selective locking engagement with the switch handle. The blocking member also includes a grooved portion for receiving a slide which may be locked in position to cover and prevent access to the fastener.

6 Claims, 1 Drawing Sheet

ELECTRICAL SWITCH LOCKING SYSTEM

BACKGROUND, BRIEF SUMMARY AND OBJECTS OF THE INVENTION

This invention relates generally to electrical switches and more particularly to a locking assembly for locking a switch handle in either the ON or OFF position for preventing movement thereof.

While the locking assembly could be used with various types of switches, including wall mounted light switches and circuit breakers, the invention will be described in association with circuit breakers.

There are various instances when it becomes necessary to ensure that one or more circuit breakers in a panel board be inoperable when electrical equipment is shut down for maintenance, repair, or replacement. If the electrical equipment is located remote to the circuit breaker, there is the ever present danger that someone may close the circuit breaker. The present invention provides for a locking assembly which may be secured to block movement of the circuit breaker handle such that an unauthorized person cannot tamper with or remove the assembly and activate the circuit.

There are many prior art locking assemblies as disclosed, for example, in U.S. Pat. No(s). 4,467,152; 4,733,029; 4,581,502; 2,849,552; 4,978,816; and 4,882,456. However, the present invention overcomes several d prior art devices.

The present invention relates to a locking assembly adapted to be secured to a switch handle wherein modification of the switch handle or switch panel structure or housing is not required.

In the present invention the locking assembly includes a blocking member which is positioned over the switch handle and secured thereto by a fastener. The blocking member abuts the switch housing in such a manner to prevent pivoting of the switch handle. A slide cover extends over the fastener and is secured in position by a padlock to prevent unauthorized access to the fastener.

One of the primary objects of the invention is the provision of an assembly for restricting the movement of switch handles and which is readily attached to existing switch handles without modification thereto or to the switch housing.

Another object of the invention is the provision of a locking assembly which is inexpensive to manufacture and which is provided with means for quick attachment to and removal from the switch handle.

Other objects and advantages of the invention will become apparent when considered in view of the following detailed description of the invention and the drawing.

DETAILED DESCRIPTION OF THE INVENTION

Figure 1:
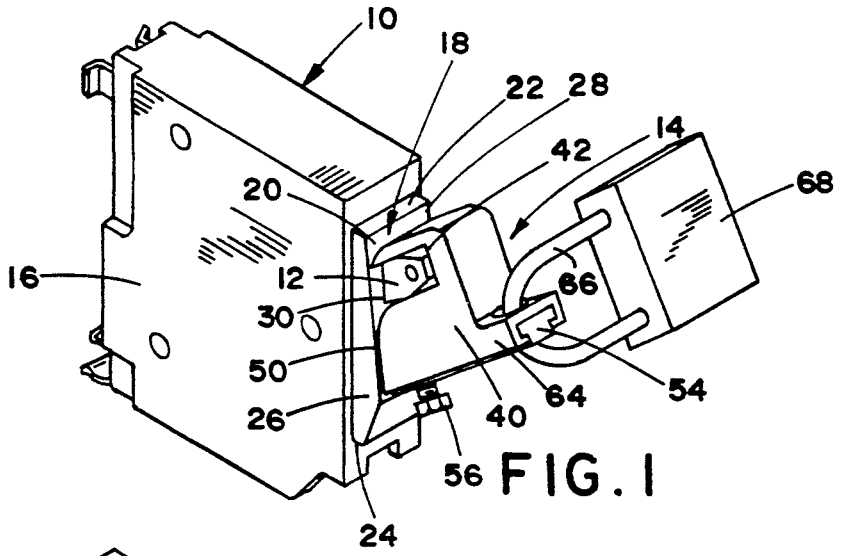
FIG. 1 is a perspective view of the locking assembly of the present invention applied to the switch handle of a circuit breaker, and a padlock applied thereto for preventing its removal.

Referring to the drawing, FIG. 1 illustrates a switch 10, having an operating handle 12 adapted to be selectively displaced between ON and OFF positions. Adapted to be readily and conveniently applied to the operating handle 12 is a locking assembly 14 for retaining the operating handle in either an ON or OFF position.

Figure 3:
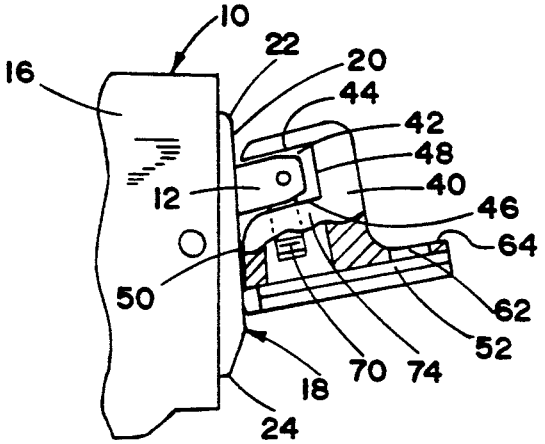
FIG. 3 is a fragmentary, side elevational view of the locking assembly blocking member secured to a switch handle by the fastener.
Figure 4:
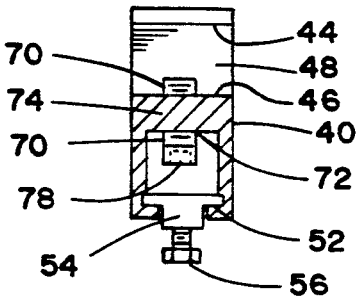
FIG. 4 is an elevational view of the blocking member, fastener and slide member, with a portion of the blocking member being cut away.

As shown in FIGS. 1 and 3, the switch 10 consists of a circuit breaker having a casing or housing 16 which includes a generally rectangular portion 18 defining a rather planar surface 20 delimited by opposed end walls 22,24 and opposed side walls 26,28. The operating handle 12 projects through an opening or slot 30 in the rectangular position 18 of the casing. Since the details of the circuit breaker do not form an essential part of this invention, they have not been illustrated or described herein.

The locking assembly 14 includes an integral blocking member 40 having opposed surfaces 44 and 46 and surface 48 defining or slot or recess 42 for receiving the operating handle 12. The slot 42 is sized to accept and generally correspond to the thickness of the operating handle 12 with the surfaces 44,46 generally abutting opposed sides of the operating handle 12 to substantially eliminate movement of the handle 12 within the slot 42.

The blocking member 40 also includes a surface portion 50 for abutting the planar surface 20, and has surfaces defining a slot 52 having a generally T-shaped cross-sectional configuration for receiving a slide member 54 having a generally T-shaped cross-section. The lengths of the slide member 54 and the slot 52 generally correspond. The slide member 54 having a generally corresponds in size with an opening 62 extending through a portion 64 of the blocking member 40. A handle 56 is fixed to the slide member 54 to facilitate displacement thereof.

When properly positioned in the slot 52, the opening 60 in the slide 54 is aligned with the opening 62 in the blocking member for receiving therethrough the bow or shackle 66 of a padlock 68.

Figure 2:
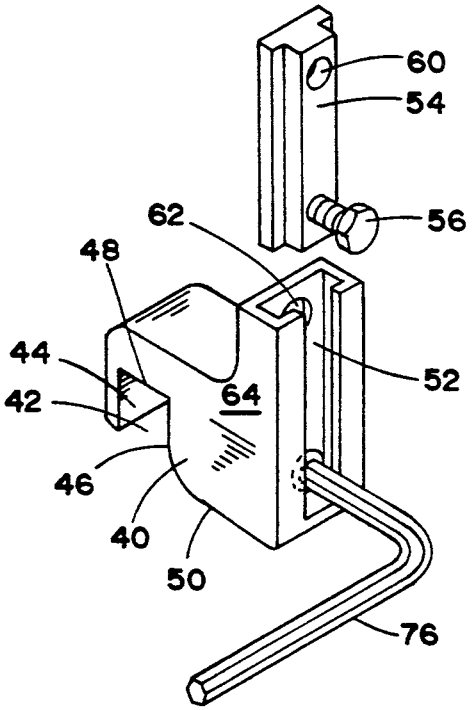
FIG. 2 is an enlarged, exploded, perspective view of the locking assembly illustrating the blocking member, the fastener therein, a wrench for operating the fastener, and the slide member for covering the fastener.

In the locked position, fixed by the padlock 68, the slide 54 prevents access to a fastener 70 which is adapted to abut or be displaced from the switch operating handle 12. The fastener may take various forms. In the illustrated embodiment, the fastener 70 comprises an Allen screw which is threaded through a transverse opening 72 in portion 74 of the blocking member 40. As shown in FIG. 2, an Allen wrench 76 extends through the slot 52 and engages the recess 78 in the Allen screw 70 for tightening the screw into gripping, locking engagement with the switch operating handle 12, or for loosening the screw 70 to permit removal of the locking assembly 14 from the handle 12.

When the assembly is to be applied to a switch operating handle 12, the locking assembly is positioned with the handle 12 within the recess 42 and the surface 50 abutting the switch housing surface 20. The slide member 54 is removed from the slot 52, or slide upwardly sufficiently to permit access of an Allen wrench 76 to the Allen screw 70. The Allen wrench 76 is then used to tighten the Allen screw 70 in gripping, locking engagement with the handle 12 to locking the blocking member 40 to the handle 12. Once tightened, the Allen wrench is removed, the slide member 54 moved downwardly to the FIG. 1 position covering the fastener 70 and located such that the openings 60,62 are aligned. The insertion of a padlock 68 through the aligned openings prevents displacement of the slide member 54 thus preventing access to the fastener 70.

The blocking member 40 and slide 54 may be of various suitable materials, including metal, and may be of various sizes.

What is claimed is:

1. In an electrical switch operating handle locking assembly, a blocking member having surfaces defining a recess for receiving an electrical switch operating handle, an integral blocking portion for abutting an electrical switch housing, and a portion defining an elongated slot, said blocking member having a threaded through opening extending generally perpendicular from said elongated slot to said recess, fastening means threaded in said blocking member threaded through opening and selectively displaceable into and from said operating handle received recess to selectively grip or release an operating handle, means displaceable in said slot to selectively close access to said fastening means threaded in said through opening, and means including aligned openings in said displaceable means and said portion defining said elongated slot for selectively preventing movement of said displaceable means within said slot.

2. In an electrical switch operating handle locking assembly as recited in claim 1, said means for selectively preventing movement of said displaceable means within said slot comprising aligned openings in said blocking member and said means displaceable in said slot and lock means extending through said aligned openings to prevent displacement of said displaceable means in said slot and prevent access to said fastener means.

3. In an electrical switch operating handle locking assembly as recited in claim 1, said slot having a T-shaped cross-sectional configuration and said means displaceable in said slot having a T-shaped cross-sectional configuration.

4. In a switch handle holding assembly, a one-piece blocking means defining a first portion having opposed, generally parallel surfaces defining a recess for receiving a switch handle therebetween, said blocking means having an integral second portion having opposed surfaces defining an elongated slot therein, said blocking means having a third integral portion defining a threaded opening extending therethrough from said recess to said slot, said threaded opening extending generally perpendicular to said first portion opposed surfaces and to said elongated slot, a threaded fastener received within said threaded opening for selective displacement into and out of gripping engagement with a switch handle positioned within said recess, said blocking means having a fourth integral portion defining a lock receiving opening therein, a slide member retained in said elongated slot for displacement therein, said slide member defining a lock receiving opening therein, said slide capable of being displaced between a first position wherein said lock receiving opening therein is not aligned with said fourth portion lock receiving opening to permit access to the threaded fastener, and a second position wherein said lock receiving opening is aligned with said fourth portion lock receiving opening for receiving the shackle of a padlock therethrough to prevent access to said threaded fastener.

5. The combination of an electrical switch having an operating handle, a switch casing having a slot in which said handle is moveable between "off" and "on" and a blocking member, said blocking member having a first portion provided with opposed, generally parallel surfaces defining a recess therein for receiving said operating handle, a second portion having walls defining an elongated slot therein, said elongated slot extending substantially parallel to said opposed, generally parallel surfaces defining said recess, a slide member configured to abut said walls defining said slot and received within said slot, a third portion having a surface extending generally perpendicular to said elongated slot and said parallel surfaces for abutting said switch casing, a threaded opening extending through said blocking member and communicating with said recess and said slot and extending generally parallel to said abutting surface of said third portion, threaded fastener means in said threaded opening and selectively displaceable to release or grip said operating handle, said slide member and said blocking member each having a lock receiving opening therein, said slide member being capable of slidable displacement between a position to permit access to said threaded fastener means and a position covering said threaded fastener means wherein said slide member and said blocking member openings aligned for receiving a lock therethrough to prevent unauthorized access to said threaded fastener means.

6. The combination as recited in claim 5, and further including a lock having a portion for passing through said slide member opening and said blocking member opening.

* * * * *